United States Patent [19]

May

[11] 3,938,069

[45] Feb. 10, 1976

[54] METAL OXIDE VARISTOR WITH PASSIVATING COATING

[75] Inventor: John E. May, Skaneateles, N.Y.

[73] Assignee: General Electric Company, Syracuse, N.Y.

[22] Filed: Sept. 26, 1974

[21] Appl. No.: 509,337

Related U.S. Application Data

[62] Division of Ser. No. 401,334, Sept. 27, 1973, Pat. No. 3,857,174.

[52] U.S. Cl. ..... 338/21; 29/612; 29/620; 252/518; 427/376

[51] Int. Cl.[2] ..... H01C 7/12

[58] Field of Search ..... 338/20, 21; 117/201, 212, 117/215, 217; 29/620, 612, 621; 252/518–520; 427/376

[56] References Cited

UNITED STATES PATENTS 3,723,175 3/1973 Masuyama et al. ..... 17/217

*Primary Examiner*—C. L. Albritton

*Attorney, Agent, or Firm*—R. J. Mooney; D. E. Stoner

[57] ABSTRACT

A metal oxide varistor comprising a body portion that is composed essentially of a metal oxide and a small percentage of a plurality of preselected additives. A passivating coating is applied to the body portion prior to the application of metallic contacts. The passivating coating includes at least some of the preselected additives in order to enhance device stability and insure compatibility therewith.

4 Claims, 2 Drawing Figures

METAL OXIDE VARISTOR WITH PASSIVATING COATING

This is a division of application Ser. No. 401,334, filed Sept. 27, 1973, now U.S. Pat. No. 3,857,174.

BACKGROUND OF THE INVENTION

This invention relates to metal oxide varistors and, more particularly, to a passivating coating for improving the stability and electrical characteristics of metal oxide varistors.

In general, the current flowing between two spaced points is directly proportional to the potential difference between those points. For most known substances, current conduction therethrough is equal to the applied potential difference divided by a constant, which has been defined by Ohm's law to be its resistance. There are, however, a few substances which exhibit non-linear resistance. Some devices, such as metal oxide varistors, utilize these substances and require resort to the following equation (1) to quantitatively relate current and voltage:

$$I = \left(\frac{V}{C}\right)^{\alpha} \qquad (1)$$

where V is the voltage applied to the device, I is the current flowing through the device, C is a constant and $\alpha$ is an exponent greater than 1. Inasmuch as the value of $\alpha$ determines the degree of non-linearity exhibited by the device, it is generally desired that $\alpha$ be relatively high. $\alpha$ is calculated according to the following equation (2):

$$\alpha = \frac{\log_{10}(I_2/I_1)}{\log_{10}(V_2/V_1)} \qquad (2)$$

where $V_1$ and $V_2$ are the device voltages at given currents $I_1$ and $I_2$, respectively.

At very low voltages and very high voltages metal oxide varistors deviate from the characteristics expressed by equation (1) and approach linear resistance characteristics. However, for a very broad useful voltage range the response of metal oxide varistors is as expressed by equation (1).

The values of C and $\alpha$ can be varied over wide ranges by changing the varistor formulation and the manufacturing process. Another useful varistor characteristic is the varistor voltage which can be defined as the voltage across the device when a given current is flowing through it. It is common to measure varistor voltage at a current of 1 milliampere and subsequent reference to varistor voltage shall be for voltage so measured. Still another useful varistor characteristic is the leakage current. This is the dc steady state current through the device when it is exposed to one-half of its varistor voltage. A high leakage current causes wasted power and, if high enough, can cause joule heating of the device, which leads to a higher current. Thus, high leakage current can lead to thermal runaway. The foregoing is, of course, well known in the prior art.

Metal oxide varistors are usually manufactured as follows. A plurality of additives is mixed with a powdered metal oxide, commonly zinc oxide. Typically, four to 12 additives are employed, yet together they comprise only a small portion of the end product, for example less than five to ten mole percent. In some instances the additives comprise less than one mole percent. The types and amounts of additives employed vary with the properties sought in the varistor. Copious literature describes metal oxide varistors utilizing various additive combinations. For example, see U.S. Pat. No. 3,663,458. A portion of the metal oxide and additive mixture is then pressed into a body of a desired shape and size. The body is then sintered for an appropriate time at a suitable temperature as is well known in the prior art. Sintering causes the necessary reactions among the additives and the metal oxide and fuses the mixture into a coherent pellet. Following sintering metallic contacts are applied and leads are fixed to the contacts. Finally, the device is generally encapsulated.

Problems encountered in varistors manufactured by the prior art method include poor stability and a current leakage that renders the device unsuitable for certain applications. Different varistor formulations have been tested in an effort to control the leakage current, but none has heretofore been fully acceptable. Passivating coatings are sometimes used to enhance the stability and reduce the leakage current of the device. However, the heretofore known coatings are not completely successful and, in addition, the constituents of the coating sometimes have an adverse effect on the electrical characteristics of the device.

It is, therefore, an object of this invention to provide a passivating coating for metal oxide varistors that is fully compatible therewith and improves device stability and reduces leakage current thus providing substantially improved devices.

SUMMARY OF THE INVENTION

This invention is characterized by a metal oxide varistor comprising a body portion that is composed essentially of a metal oxide and a small percentage of a plurality of preselected additives. The metal oxide and the additives are mixed and then a portion of the mixture is pressed into a body of a desired shape and size. The pressed body is then sintered to form the varistor body in a manner well known in the prior art. A coating is then applied to the body and it is reheated as described below. Metal contacts are applied and wire leads are attached to the contacts. The device is then ready to be encapsulated.

A feature of the subject coating is that it is a passivating coating and substantially improves the stability of the devices as discussed below. In order to provide a coating compatible with the varistor body portion, the preselected additives form a major portion of the coating. Thus, compatibility of the coating and the varistor is assured.

The preselected additives can be prereacted to form a reaction product which is ground and then mixed with the metal oxide prior to pellet pressing and sintering. It has been found that such a technique provides a varistor with very desirable electrical properties, high stability and of a very uniform composition. A full discussion of the method for fabricating a varistor by prereacting the additives is in my co-pending U.S. patent application filed concurrently herewith, assigned Ser. No. 401,131 and entitled "Low Voltage Varistor and Process for Making." The coating can comprise the reaction product. A carrier can be included, as is disclosed below, to enhance the adhesion of the reaction product to the body portion surface.

Another feature of the coating is that it is free of silver and other monovalent ions that tend to diffuse rapidly into the varistor pellet during the step of heating the coating. It is advantageous to prevent such ion diffusion inasmuch as it causes high leakage current and other effects on the varistor properties that are difficult to predict. Furthermore, the coating can be made free of silicon as disclosed below. It has been found that the inclusion of silicon in a varistor pellet coating increases the varistor voltage of the treated device. Thus, when fabricating low voltage varistors, it is preferable that the coating be free of silicon.

Yet another feature of the invention is that the coating enhances the contact adhesion. A preferred method of enhancement is to contour the surface of the varistor body. For example, particulate matter can be included in the coating and the step of heating the coating can be carried out, as described below, at a temperature that does not melt the particulate matter.

Inasmuch as metal contacts, when applied by such conventional methods as the application and heating of silver paste or the utilization of a metallic flame spray, closely conform to the contour of the substrate surface, in this case the varistor pellet surface, it will be appreciated that a substantial increase in contact adhesion will be realized by the utilization of a contoured pellet surface.

It is, of course, realized that other methods of contouring the surface of the pellet can be employed. For example, a coating that shrinks as cured can be employed. The shrinking coating will develop cracks that create a contoured surface effect.

Inasmuch as coatings are often applied to varistor bodies when manufactured by conventional methods, it will be appreciated that little extra cost will be incurred in the manufacture of the subject varistor since coating equipment is at the disposal of varistor manufacturers.

Consequently, it will be appreciated that there has been provided a coating for metal oxide varistors that functions as a passivating coating to improve the stability of the device. The coating is fully compatible with the varistor body portion, and, inasmuch as the coating is free of monovalent ions, does not adversely alter the electrical properties of the varistor. Furthermore, the coating can be free of silicon if a low voltage device is being manufactured. Finally, the coating enhances the adhesion of the contacts to the varistor body portion, thus preventing device failure due to detached, cracked or torn contacts.

DESCRIPTION OF THE DRAWINGS

These and other features and objects of the present invention will become more apparent upon a perusal of the following description taken in conjunction with the accompanying drawings wherein.

DESCRIPTION OF THE PREFERRED EMBODIMENT AND METHOD

Figure 1:
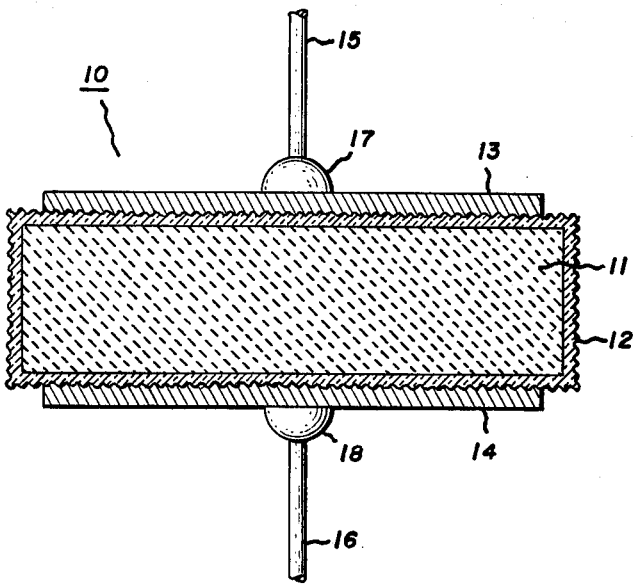
FIG. 1 is a sectional view of a preferred metal oxide varistor.

Referring first to FIG. 1 there is shown a metal oxide varistor 10 that includes a sintered body portion 11 composed essentially of a metal oxide and a plurality of preselected additives. The body 11 can be manufactured by methods well known in the prior art or by an improved technique to be discussed below. Surrounding the body portion is a passivating coating 12 and, overlying the coating on two major surface areas of the body, are two metallic contacts 13 and 14. Two wire leads 15 and 16 are coupled to the contacts 13 and 14, respectively, by conductive couplers such as solder 17 and 18.

Figure 2:
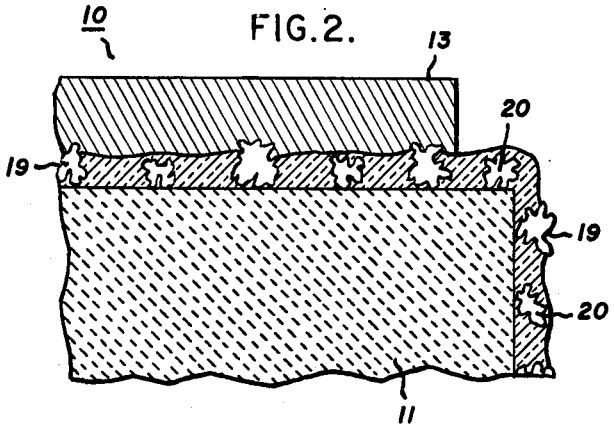
FIG. 2 is a detailed sectional view of a portion of the varistor depicted in FIG. 1.

Referring now to FIG. 2 there is shown a portion of the varistor 10 shown in FIG. 1. Specifically, a corner of the body portion 11 is shown in FIG. 2. In the enlarged FIG. 2, the passivating coating 12 is more clearly visible. It is seen to consist of a coating material with particulate matter embedded therein. It will be appreciated that some of the grains 19 of the particulate matter project beyond the surface of the coating 12 while other grains, such as the grains 20, are completely encapsulated by the coating. The grains 19 and 20 are part of a contact adhesion enhancement system included in the coating 12. It will be appreciated that the surface of the coating 12 is substantially roughened or contoured as compared to what it would be were the contouring particles 19 and 20 absent. It has been found that contacts applied by the conventional methods such as by application of silver paste or by metallic flame spraying do closely conform to surface irregularities. Thus, it will be appreciated that the contact 13 will adhere more tenaciously to the irregular surface than to a smooth surface. The includion of the particulate matter 19, 20 as described below has been found to increase the surface irregularity by at least one order of magnitude. Consequently, a substantial enhancement of contact ahesion is obtained.

In order to provide good passivating qualities and to be fully compatible with the pellet 11, the coating 12 preferably comprises at least some of the preselected additives. For example, it has been found that an effective passivating coating can be provided utilizing the "reaction product" that is discussed in my co-pending U.S. application entitled "Low Voltage Varistor and Process for Making," filed concurrently herewith. Briefly, the reaction product described therein is formed by thoroughly mixing the preselected additives in the absence of the metal oxide and then prereacting the additives. For example, the additives can be heated and cooled and thus fused into a solid body. This body is then ground to form the reaction product. The metal oxide is mixed with the reaction product and pressed and sintered in the conventional manner.

As specifically described in my previously referenced co-pending U.S. application, a varistor with excellent electrical characteristics can be fabricated from 98 mole percent zinc oxide, 0.5 mole percent bismuth oxide, 0.5 mole percent cobalt oxide, 0.5 mole percent manganese oxide, and 0.5 mole percent titanium oxide. In accordance with the method disclosed in my co-pending application, the oxides of bismuth, cobalt, manganese and titanium are thoroughly mixed in equal molar amounts, then heated and cooled to form a crystalline solid body. The crystalline solid body is ground to form the reaction product. Zinc oxide and the reaction product are thoroughly mixed and a portion of the mixture is pressed and sintered to form the varistor body 11.

For the specific formulation of a varistor described above, effective passivating coatings can be produced from any of the following base materials:

1. 16 gms. Reaction Product
2. 10.5 gms. Reaction Product + 5.7 gms. $Bi_2O_3$
3. 14.5 gms. Reaction Product + 2.6 gms. $H_3BO_3$ 4. 10.5 gms. Reaction Product + 5.7 gms. $Bi_2O_3$ + 1.9 gms. $H_3BO_3$
5. 10.5 gms. Reaction Product + 5.7 gms. $Bi_2O_3$ + 1.9 gms. $H_3BO_3$ + 3.6 gms. $Sb_2O_3$
6. 50 gms. Reaction Product + 30 gms. $Bi_2O_3$ + 15 gms. $H_3BO_3$ + 7 gms. $SiO_2$ With respect to the above formulas, it will be appreciated that the sixth formula can be used in medium or high voltage varistors, but it may be desired to avoid the sixth formula, which includes silicon, in the manufacture of low voltage varistors inasmuch as silicon increases the voltage rating of a varistor. Furthermore, it will be appreciated that each of the above formulations is free of silver and other monovalent ions that would tend to diffuse rapidly through the varistor body 11 during the coating heating step to be described subsequently. Such a diffusion of monovalent ions could adversely affect the stability of the varistor 10 and affect the final electrical properties of the device in a manner difficult to preduct. Thus, it is beneficial to omit silver and other monovalent ions from the varistor formulation for reasons more fully discussed in a copending U.S. application entitled "Silver Free Varistor Passivating Coating," filed by S. I. Gabrail concurrently herewith and assigned to the same assignee as this application. The application of Gabrail was assigned Ser. No. 401,323 and is now abandoned.

The compounds of bismuth, boron, antimony, and silicon, where included, are carriers and serve to ultimately enhance the adhesion of the particulate matter 19 and 20 to the body 11.

In order to apply the passivating coating, any of the above formulas is selected and mixed with a vehicle to facilitate handling. A vehicle that has been found effective for the above formulations is composed of 135 grams of n butyl acetate, 20 grams of ethyl cellulose and 15 grams of butyl carbitol.

Application of the coating is as follows. The coating, which when mixed with the vehicle is fluid, is poured over the sintered bodies 11 or the bodies 11 are dipped in the coating. The vehicle is then dried at a relatively low temperature. The devices are then heated to a temperature in the range of 600° to 1000°C for a preselected time. The temperature and time selected should insure that the carrier is fused and thus enhances the adhesion of the particulate matter 19 and 20 to the body 11. However, the particulate matter 19 and 20 should not melt so that a body 11 with the coating 12 and the irregular surface depicted in FIG. 2 is provided. FOllowing the heating step, the metal contacts 13 and 14 are applied by conventional techniques such as the application of silver paste or flame spraying. As mentioned previously, the contacts 13 and 14 will closely conform to the irregular surface of the body 11 and thus adhere tightly thereto.

It will be appreciated that if it is desired for any reason, the carrier can be utilized with different particulate matter. For example, other suitable particulate matter is grains of aluminum oxide.

In summary it will be appreciated that there has been provided a varistor with a passivating coating that reduces leakage current, improves device stability and enhances contact adhesion. Tests have shown that contact adhesion is improved by at least one order of magnitude and leakage current is reduced by several orders of magnitude. Thus, an extremely desirable varistor and method of manufacture have been disclosed.

Many modifications and variations of the subject invention will be apparent to those skilled in the art. For example, other carriers and vehicles can be used. In addition, it will be appreciated that when the aforementioned first formula is used, only reaction product and vehicle is put on the body. Thus when using the first formula, the coating is the reaction product only. Furthermore, it is realized that when certain carriers are employed, they are substantially entirely absorbed into the outer portion of the varistor body but do aid in the adhesion of the particulate matter, which is still "embedded" therein, although only partially. Consequently, the true scope of the invention is as defined by the following claims.

What I claim as new and desire to secure by Letters Patent of the United States is:

1. A metal oxide varistor comprising a body portion consisting essentially of a metal oxide and a relatively small amount of a plurality of additives and with a passivating coating on said body portion, said coating comprising a granular reaction product obtained by prereacting said additives.

2. A varistor according to claim 1 wherein said coating further comprises carrier means for enhancing adhesion between said body portion and said reaction product.

3. A varistor according to claim 2 wherein said carrier means comprises a compound of at least one member of the group consisting of bismuth, boron, antimony, and silicon.

4. A varistor according to claim 2 wherein said additives comprise the oxides of bismuth, cobalt, manganese and titanium, and wherein said metal oxide is zinc oxide.

* * * * *